US007127202B2

(12) United States Patent
Fujita et al.

(10) Patent No.: US 7,127,202 B2
(45) Date of Patent: Oct. 24, 2006

(54) INTERMEDIARY TRANSFER APPARATUS, FIXING APPARATUS AND IMAGE FORMING APPARATUS

(75) Inventors: Takashi Fujita, Kanagawa (JP); Shigeo Kurotaka, Kanagawa (JP); Yukimichi Someya, Saitama (JP); Hiroyuki Kunii, Kanagawa (JP); Atsushi Nakafuji, Tokyo (JP); Hisashi Kikuchi, Kanagawa (JP); Katsuhiro Echigo, Saitama (JP); Toshihiko Baba, Tokyo (JP); Kohji Ue, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 170 days.

(21) Appl. No.: 10/873,381

(22) Filed: Jun. 23, 2004

(65) Prior Publication Data

US 2005/0025534 A1 Feb. 3, 2005

(30) Foreign Application Priority Data

Jun. 26, 2003 (JP) ..... 2003-182338
Mar. 18, 2004 (JP) ..... 2004-078347

(51) Int. Cl.
*G03G 15/16* (2006.01)

(52) U.S. Cl. ..... 399/307; 399/308

(58) Field of Classification Search ..... 399/297, 399/298, 302, 307, 308, 107, 121; 430/124, 430/126; 347/131
See application file for complete search history.

(56) References Cited

U.S. PATENT DOCUMENTS 4,696,418 A 9/1987 Kurotaka et al.
4,985,733 A 1/1991 Kurotori et al.
4,987,457 A 1/1991 Mochizuki et al.
5,021,834 A 6/1991 Tsuruoka et al.
5,153,651 A 10/1992 Kurotaka
5,155,531 A 10/1992 Kurotori et al.
5,155,534 A 10/1992 Kurotori et al.
5,359,398 A 10/1994 Echigo et al.
5,384,225 A 1/1995 Kurotori et al.
5,456,782 A 10/1995 Fujita et al.
5,463,447 A 10/1995 Kurotori et al.
5,463,453 A 10/1995 Kurotori et al.
5,493,365 A 2/1996 Matsui et al.
5,504,590 A 4/1996 Kawada et al.
5,513,026 A 4/1996 Suzuki et al.
5,566,013 A 10/1996 Suzuki et al.
5,592,275 A 1/1997 Echigo et al.
5,610,725 A 3/1997 Kawada et al.
5,642,188 A 6/1997 Mochizuki et al.
5,652,803 A 7/1997 Tachikawa et al.
5,659,628 A 8/1997 Tachikawa et al.
5,678,158 A 10/1997 Kurotori et al.
5,678,161 A 10/1997 Kurotaka et al.

(Continued)

FOREIGN PATENT DOCUMENTS

JP 7-225524 8/1995

(Continued)

*Primary Examiner*—Hoan Tran
(74) *Attorney, Agent, or Firm*—Oblon, Spivak, McClelland, Maier & Neustadt, P.C.

(57) ABSTRACT

An intermediary transfer apparatus for transferring an unfixed image from an intermediary transfer member to a recording medium is disclosed. The intermediary transfer apparatus includes a heating unit for selectively heating a prescribed portion of the intermediary transfer member on which the unfixed image is situated, in a width direction of the intermediary transfer member, the width direction of the intermediary transfer member perpendicularly intersecting the direction in which the unfixed image is conveyed.

21 Claims, 14 Drawing Sheets

U.S. PATENT DOCUMENTS 5,708,949 A 1/1998 Kasahara et al.
5,751,854 A 5/1998 Saitoh et al.
5,783,288 A 7/1998 Fujita et al.
5,890,043 A * 3/1999 Uehara ..... 399/307
6,055,390 A 4/2000 Kurotaka et al.
6,078,766 A 6/2000 Kurotaka
6,088,558 A 7/2000 Yamada et al.
6,108,906 A 8/2000 Fujita et al.
6,122,479 A 9/2000 Fujita et al.
6,150,066 A 11/2000 Kurotori et al.
6,175,713 B1 * 1/2001 Uehara et al. ..... 399/307
6,198,888 B1 3/2001 Kurotaka et al.
6,243,559 B1 6/2001 Kurotaka et al.
6,256,051 B1 * 7/2001 Asada et al. ..... 347/131
6,259,880 B1 * 7/2001 Jia et al. ..... 399/307
6,262,787 B1 7/2001 Kamoi et al.
6,272,248 B1 8/2001 Saitoh et al.
6,347,212 B1 2/2002 Kosugi et al.
6,366,751 B1 4/2002 Shakuto et al.
6,501,935 B1 12/2002 Hirai et al.
6,529,701 B1 * 3/2003 Baba et al. ..... 399/307
6,535,701 B1 3/2003 Baba
6,542,705 B1 4/2003 Fujita et al.
6,559,421 B1 5/2003 Yura et al.
6,625,409 B1 9/2003 Shakuto et al.
6,631,253 B1 10/2003 Nakafuji et al.
6,636,718 B1 10/2003 Yura et al.
6,646,227 B1 11/2003 Yura et al.
6,654,579 B1 11/2003 Shakuto et al.
6,721,532 B1 4/2004 Kosugi et al.

FOREIGN PATENT DOCUMENTS

JP 10-63121 3/1998
JP 2000-214724 8/2000
JP 2002-10057 1/2002
JP 2002-268420 9/2002
JP 2002-357927 12/2002
JP 2003-17237 1/2003

* cited by examiner

CHEMICAL FORMULA 2

CHEMICAL FORMULA 1

INTERMEDIARY TRANSFER APPARATUS, FIXING APPARATUS AND IMAGE FORMING APPARATUS

BACKGROUND OF THE INVENTION

1. Field of the Invention

The present invention relates to an intermediary transfer apparatus and a fixing apparatus which are used for an image forming apparatus such as a copier, and an image forming apparatus using the intermediary transfer apparatus and the fixing apparatus, and more particularly to a technology for thermally fixing images with an electrophotographic image forming apparatus.

2. Description of the Related Art

With a conventionally known electrophotographic type image forming apparatus having a fixing apparatus, an image is formed, typically, by conveying a recording medium (e.g. paper) having an unfixed toner (toner image) transferred thereon while heating the unfixed toner (toner image). One particularly known exemplary image forming apparatus transfers an image from an image carrier (e.g. photoconductor) to a recording medium via an intermediary transfer member (e.g., intermediary transfer belt). In each transfer process using the foregoing image forming apparatuses, the quality of the transferred image and/or steady transfer performance may be affected by factors such as image deviation caused from speed differences for conveying the target image, and dryness and thickness of the recording medium.

Accordingly, in one conventional example, toner on an intermediary transfer member is simultaneously transferred and fixed by directly heating and pressing the toner onto a recording medium. For example, as shown in Japanese Patent Registration No. 3042414 and Japanese Laid-Open Patent Application No. 7-225524, a technology where a heating member is disposed in a manner stretching an intermediary transfer member at its inner peripheral surface for pressingly heating a toner from the inner peripheral surface.

In another conventional example, a secondary transfer technique is proposed, in which toner, instead of being heated at an intermediary transfer member, is heated from an outer side after being transferred from the intermediary transfer member to a fixing member.

Nevertheless, in the above-described example where the toner is heated from the inner peripheral surface constantly at the contacting portion between the heating member and the intermediary transfer member, the entire area of the intermediary transfer member is heated to a high temperature, thereby requiring a time to cool for contacting the image carrier at which developing is performed. In order to attain a cooling performance, the intermediary transfer member is required to extend its peripheral length. This results to forming the apparatus with a large-sized body. Further, adding a cooling member for attaining the cooling performance increases component manufacture cost. Further, heating the intermediary transfer member to a predetermined temperature leads to an increase in the rise time of the apparatus.

Furthermore, spaces between the transfer target recording media are also subjected to heating since the intermediary transfer member is constantly heated. This is a disadvantage from an energy saving aspect. The heat radiation from the highly heated heating member and the intermediary transfer member causes the temperature inside the image forming apparatus to rise, and may lead to generation of unsatisfactory images due to, for example, toner fused onto the image carrier.

Furthermore, with the secondary transfer technique, since a portion of the fixing member on which toner is not disposed is heated more than a portion of the fixing member on which toner is disposed, the intermediary transfer member becomes heated by contacting the fixing member. Although the increase in the temperature of the intermediary transfer member is relatively subtle that the toner or photoconductor may not be damaged during transfer to the fixing member or the transfer from the photoconductor to the intermediary transfer medium, such temperature rise may eventually accumulate enough energy to cause a large amount of damage.

In another conventional example, a technology is proposed in which temperature rise of the intermediary transfer member, the fixing member, and the inside of the apparatus is restrained by selectively heating only a portion where an image is not fixed, for generating steady, high quality images. In order to execute this technology, a non-contacting heating unit for heating the toner is mainly employed. This, however, requires usage of a toner containing an infrared absorbing agent for absorbing radiant energy, thereby restricting the use of bright colors and the reproduction of colors. Furthermore, although a contacting heating unit may be employed for executing the selective heating procedure (e.g. contacting a heating member with a fixing roller), this may cause the surface of the fixing roller to easily wear away.

SUMMARY OF THE INVENTION

It is a general object of the present invention to provide an intermediary transfer apparatus, fixing apparatus, and an image forming apparatus that substantially obviate one or more of the problems caused by the limitations and/or disadvantages of the related art.

Features and advantages of the present invention will be set forth in the description which follows, and in part will become apparent from the description and the accompanying drawings, or may be learned by practice of the invention according to the teachings provided in the description. Objects as well as other features and advantages of the present invention will be realized and attained by an intermediary transfer apparatus, a fixing apparatus, and an image forming apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, the invention provides an intermediary transfer apparatus for transferring an unfixed image from an intermediary transfer member to a recording medium, the intermediary transfer apparatus including: a heating unit for selectively heating a prescribed portion of the intermediary transfer member on which the unfixed image is situated, in a width direction of the intermediary transfer member, the width direction of the intermediary transfer member perpendicularly intersecting the direction in which the unfixed image is conveyed.

In the intermediary transfer apparatus according to an embodiment of the present invention, the heating unit may be capable of heating the prescribed portion of the intermediary transfer member in synchronization with the conveyance of the unfixed image.

In the intermediary transfer apparatus according to an embodiment of the present invention, the heating unit may be capable of heating in a range larger than a minimum resolution spot size for recording the unfixed image.

In the intermediary transfer apparatus according to an embodiment of the present invention, the prescribed portion of the intermediary transfer member may be heated in the vicinity of where the unfixed image is transferred to the recording medium and upstream with respect to the direction in which the recording medium is conveyed.

In the intermediary transfer apparatus according to an embodiment of the present invention, the heating unit may be capable of heating the prescribed portion of the intermediary transfer member in a state not contacting the intermediary transfer member and the recording medium.

In the intermediary transfer apparatus according to an embodiment of the present invention, the heating unit may be capable of heating the prescribed portion of the intermediary transfer member by irradiating a laser beam thereto.

In the intermediary transfer apparatus according to an embodiment of the present invention, the intermediary transfer member may have a light energy absorbing property.

In the intermediary transfer apparatus according to an embodiment of the present invention, the intermediary transfer member may have a light transmittable property.

In the intermediary transfer apparatus according to an embodiment of the present invention, the laser beam may be transmitted from a side of the intermediary transfer member that is opposite to the side on which the unfixed image is situated.

In the intermediary transfer apparatus according to an embodiment of the present invention, the intermediary transfer apparatus may further include a protective member disposed at a prescribed position for receiving the laser beam via the intermediary transfer member.

In the intermediary transfer apparatus according to an embodiment of the present invention, the protective member may be a member capable of reflecting light.

In the intermediary transfer apparatus according to an embodiment of the present invention, the protective member may be a member capable of diffusing light.

Furthermore, the present invention provides an intermediary transfer apparatus for transferring an unfixed image from an intermediary transfer member to a recording medium, the intermediary transfer apparatus including: a heating unit for selectively heating a prescribed portion of the recording medium in a width direction of the intermediary transfer member, the width direction of the intermediary transfer member perpendicularly intersecting the direction in which the recording medium is conveyed.

In the intermediary transfer apparatus according to an embodiment of the present invention, the heating unit may be capable of heating the prescribed portion of the recording medium in synchronization with the conveyance of the unfixed image.

In the intermediary transfer apparatus according to an embodiment of the present invention, the heating unit may be capable of heating in a range larger than a minimum resolution spot size for recording the unfixed image.

In the intermediary transfer apparatus according to an embodiment of the present invention, the prescribed portion of the recording medium may be heated in the vicinity of where the unfixed image is transferred to the recording medium and upstream with respect to the direction in which the recording medium is conveyed.

In the intermediary transfer apparatus according to an embodiment of the present invention, the heating unit may be capable of heating the prescribed portion of the recording medium in a state not contacting the intermediary transfer member and the recording medium.

In the intermediary transfer apparatus according to an embodiment of the present invention, the heating unit may be capable of heating the prescribed portion of the recording medium by irradiating a laser beam thereto.

Furthermore, the present invention provides a fixing apparatus for transferring an unfixed image from an intermediary transfer member to a recording medium via a fixing member, the fixing apparatus including: a heating unit for selectively heating a prescribed portion of the fixing member to which the unfixed image is to be transferred from the intermediary transfer member, in a width direction of the fixing member, the width direction of the fixing member perpendicularly intersecting the direction in which the unfixed image is conveyed.

In the fixing apparatus according to an embodiment of the present invention, the heating unit may be capable of heating the prescribed portion of the fixing member in synchronization with the conveyance of the unfixed image.

In the fixing apparatus according to an embodiment of the present invention, the heating unit may be capable of heating in a range larger than a minimum resolution spot size for recording the unfixed image.

In the fixing apparatus according to an embodiment of the present invention, the prescribed portion of the fixing member may be heated in the vicinity of where the unfixed image is transferred to the recording medium and upstream with respect to the direction in which the recording medium is conveyed.

In the fixing apparatus according to an embodiment of the present invention, the heating unit may be capable of heating the prescribed portion of the fixing member in a state not contacting the fixing member and the recording medium.

In the fixing apparatus according to an embodiment of the present invention, the heating unit may be capable of heating the prescribed portion of the fixing member by irradiating a laser beam thereto.

In the fixing apparatus according to an embodiment of the present invention, the fixing member may have a light energy absorbing property.

In the fixing apparatus according to an embodiment of the present invention, the fixing member may have a light transmittable property.

In the fixing apparatus according to an embodiment of the present invention, the laser beam may be transmitted from a side of the fixing member that is opposite to the side on which the unfixed image is situated.

Furthermore, the present invention provides an image forming apparatus for forming an image on a recording medium, the image forming apparatus including: the intermediary transfer apparatus according to an embodiment of the present invention.

In the image forming apparatus according to an embodiment of the present invention, the formed image may be at least one of a monochrome image and a color image.

In the image forming apparatus according to an embodiment of the present invention, the image may be formed by using a toner containing crystalline polyester.

In the image forming apparatus according to an embodiment of the present invention, the image may be formed by using a toner containing an infrared absorbing agent.

In the image forming apparatus according to an embodiment of the present invention, a tracking pattern may be formed in an area encompassing the image.

Furthermore, the present invention provides an image forming apparatus for forming an image on a recording medium, the image forming apparatus including: the fixing apparatus according to an embodiment of the present invention.

Other objects and further features of the present invention will be apparent from the following detailed description when read in conjunction with the accompanying drawings.

DESCRIPTION OF THE PREFERRED EMBODIMENTS

In the following, embodiments of the present invention will be described in detail with reference to the accompanying drawings.

[First Embodiment]

Figure 1A:
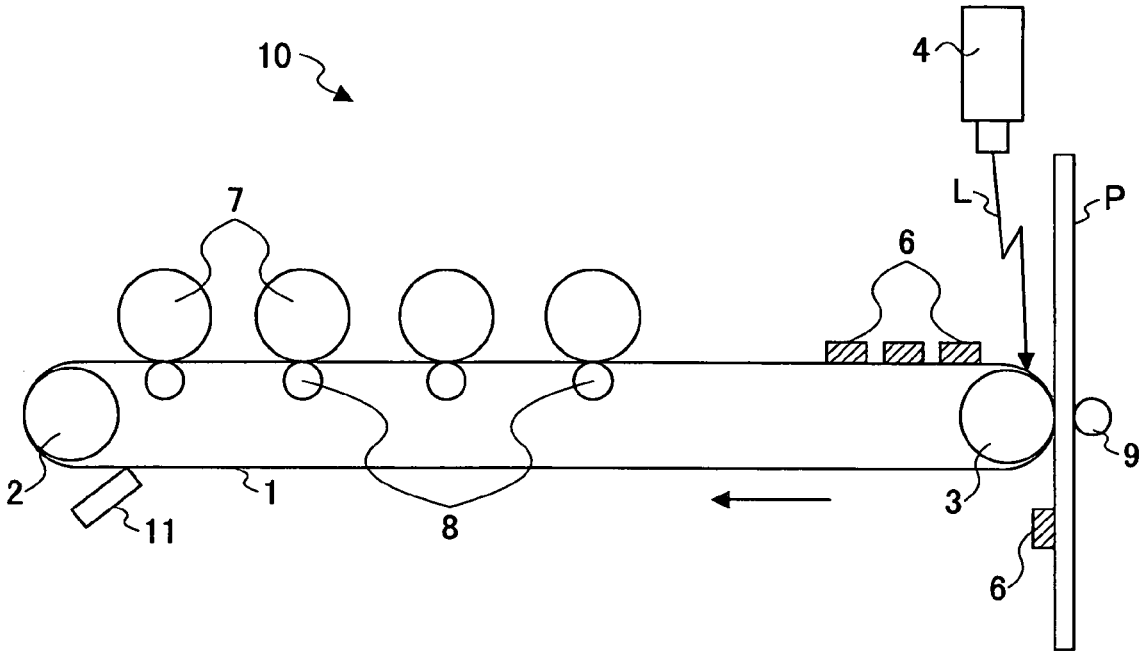
FIG. 1A is a schematic diagram showing an image forming apparatus according to a first embodiment of the present invention.
Figure 1B:
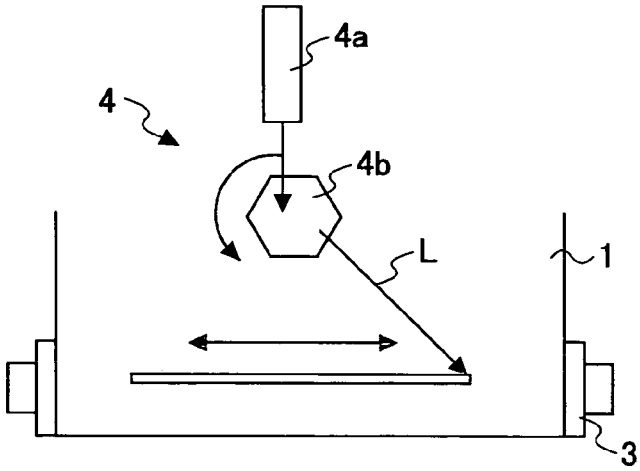
FIG. 1B is a partial plan view showing the image forming apparatus according to the first embodiment of the present invention.

FIG. 1A is a schematic drawing showing an image forming apparatus 100 according to an embodiment of the present invention, and FIG. 1B is a plan view showing the image forming apparatus 100 according to an embodiment of the present invention. In FIG. 1A, numeral 1 is an intermediary transfer member having an endless belt rotatably stretched by a driving roller 2 and a fixing roller 3. An image forming unit 10, including four image carriers 7 for forming four corresponding color toner images of Yellow (Y), Magenta (M), Cyan (C), and Black (Bk), is situated facing the intermediary transfer member 1.

The toner 6 used for development is a charged powder or a liquid. In this embodiment, for example, the temperature of the softening point of the toner 6 is 100° C. The toner 6 has a sharp melt property using a crystalline polyester resin as a binding resin. The toner 6, except for black (Bk), contains an infrared absorbing agent. By providing the toner 6 with a sharp melt property (low melting point) and reducing its softening point, the toner 6 can be softened with a small amount of energy. This enables transfer and fixing to be performed at high speed.

The image carriers 7 in the image forming unit 10 form electrostatic latent images on their surface. Although not shown in the drawings, each of the image carriers 7 is surrounded by a corresponding latent image formation process unit including a charging apparatus for uniformly charging the surface of the image carrier 7, an exposing apparatus for forming a latent image on the image carrier 7 by irradiating light to the surface of the image carrier 7, and a developing apparatus for forming a toner image (unfixed image) by allowing a toner (unfixed toner) 6 to selectively transfer onto the latent image on the image carrier 7. In addition, transfer rollers 8 are disposed in positions facing the image carriers 7 for transferring the toner images on the image carriers 7 to the intermediary transfer member 1. It is to be noted that a bias circuit (not shown) is provided to the transfer rollers 8 so that a prescribed voltage can be applied for transferring the toner 6.

The intermediary transfer member 1 according to an embodiment of the present invention is an endless belt having its surface layer provided with a satisfactory toner separating property. The driving roller 2 situated at the inner side of the intermediary transfer member 1 is rotatively driven by a driving part (not shown), thereby allowing the intermediary transfer member 1 to rotate (move) in a direction indicated by the arrow in FIG. 1A. The intermediary transfer member 1, being preferred to have a heat resisting property, employs a polyamide base material covered by 10 μm of PFA (fluorine resin) as a light (through which light can pass) transmittable material.

The fixing roller 3 has its surface layer provided with a high reflectance material. The fixing roller 3 is rotated in compliance with the rotation of the intermediary transfer member 1 being driven by the driving roller 2. A pressing roller 9, facing the fixing roller 3, is disposed in a manner abutting the intermediary transfer member 1. A recording medium P is delivered to the abutting portion between the pressing roller 9 and the intermediary transfer member 1 via a conveyance path (not shown) for allowing the toners 6 provided on the intermediary transfer belt 1 to be transferred to the recording medium P. It is to be noted that although the toners 6 provided on the intermediary transfer member 1 often come in the form of layered toners, hereinafter the toners 6 are simply referred to as toner unless described otherwise.

As shown in FIG. 1A, numeral 4 is a laser source which is disposed above the fixing roller 3 for serving as a heating source (selective heating source). With reference to FIG. 1B, the laser source 4 is capable of selectively heating the intermediary transfer member, in synchronization with the toner 6 (unfixed image) conveyed by the intermediary transfer member 1, in a width direction (axial direction) of the fixing roller 3, in which the width direction is a direction perpendicularly intersecting the conveyance direction of the toner 6.

A laser L emitted from the laser source 4 is selectively irradiated to the intermediary transfer member 1 at an upstream portion of the fixing roller 3 where the fixing roller 3 and the intermediary transfer member 1 make contact. A control part (not shown) of the image forming apparatus determines whether to irradiate the laser L, for example, by referring to information from an exposing part (not shown) that irradiates light to the image carriers 7. The control part of the image forming apparatus, by referring to the information from the exposing part, determines to irradiate the laser L when unfixed toner (unfixed image) is found within a prescribed area of the intermediary transfer member 1, and determines not to irradiate the laser L when no unfixed toner (unfixed image) is found within the prescribed area of the intermediary transfer member 1. According to the results of the determination, the laser L is irradiated in synchronization with the conveyance of the unfixed toner 6 (in correspondence with the prescribed area of the intermediary transfer member 1 where the unfixed toner 6 is to be transferred to the recording medium P). This prevents the entire intermediary transfer member 1 from being heated to a high temperature. Accordingly, fusion from the heat in the development part (not shown) and/or toner blocking, which are caused in relation to wear of the intermediary transfer member 1 and/or temperature rise in the image forming apparatus, can be prevented. Hence, a steady output of images can be achieved.

Figure 2:
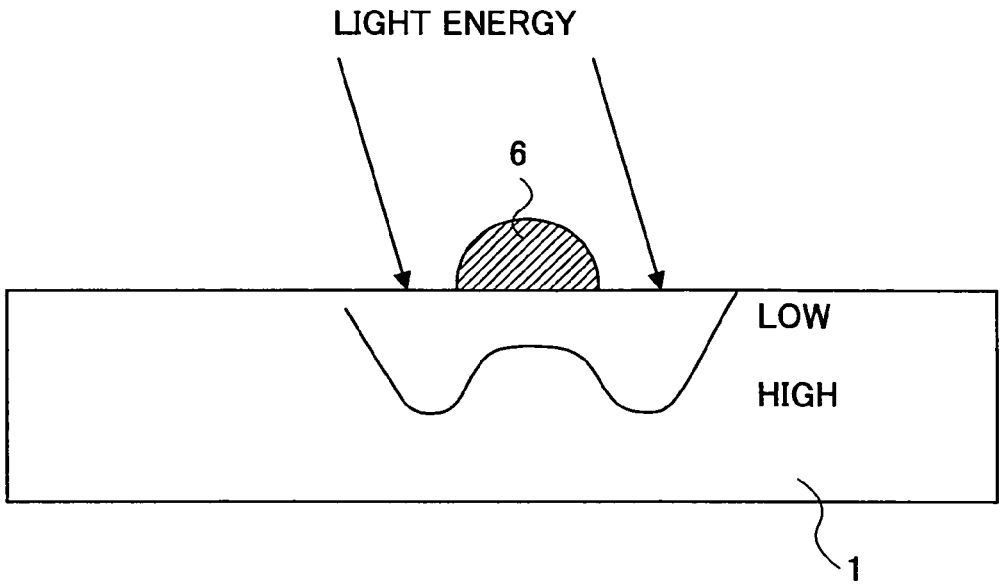
FIG. 2 is a schematic diagram showing a temperature distribution of an intermediary transfer member, according to an embodiment of the present invention, when irradiated by light energy.

The spot diameter of the laser L is set to a prescribed size (area) for achieving the foregoing results. For example, in a case where the spot size (pixel) for recording a latent image provides a minimum resolution of 600 dpi, the irradiation is to be performed with a larger spot size (range) corresponding to 72 dpi, for example. That is, the intermediary transfer member 1 is heated in prescribed separate portions (areas) thereof, in which each of the portions (areas) has a size that is larger than the minimum resolution spot size for recording images with the image forming apparatus. Therefore, a steady heating performance can be attained even when there is a discrepancy (difference) between the actual position of the unfixed toner 6 and the target irradiation area (position). Although the rise of temperature of the intermediary transfer member 1 may be prevented more effectively by irradiating (heating) with a smaller spot diameter, this reduces the assurance for irradiating the unfixed toner 6. That is, the unfixed toner 6 can irradiated more surely by making the spot diameter larger than the pixel (size) for recording an image (latent image). FIG. 2 is a schematic drawing showing the distribution of the temperature of the intermediary transfer member 1 when irradiated by light energy (radiant energy). Further, with reference to FIG. 1B, numeral 4*a* indicates a laser, and numeral 4*b* indicates a polygon mirror, in which the laser beam L is irradiated by scanning a lens or the like (not shown) along an axial direction of the fixing roller 3.

In FIG. 1, numeral 11 is a cleaner situated downstream from the contacting portion between the intermediary transfer member 1 and the recording medium P. The cleaner 11 is disposed in contact with the intermediary transfer member 1 for collecting toner not transferred to the recording medium P, but remaining on the intermediary transfer member 1.

Next, the operation of transferring and fixing the toner 6 to the recording medium P is described. After the toner 6 is heated and softened on the intermediary transfer member 1 by the irradiation of the laser beam L, the toner 6 is conveyed to a position between the recording medium P and the pressing roller 9. Here, the pressing roller 9 presses the toner 6 against the recording medium P so that the toner 6 can penetrate into the fibers of the recording medium P. Thereby, the toner 6 is transferred onto the recording medium P. Here, the heat of the toner 6 is absorbed by the recording medium P, and the toner 6 becomes fixed to the recording medium P as the toner 6 solidifies along with the cooling of temperature. Then, the recording medium P is discharged from the image forming apparatus via a conveyance passage (not shown).

Accordingly, in performing the above-described operation, it is preferable to irradiate the laser beam L to the toner 6 situated on the intermediary transfer member 1 in the vicinity of where the toner 6 is transferred to the recording medium P. This is to shorten the time for the heated toner 6 to reach the recording medium P and prevent the heated toner 6 from cooling before it reaches the recording medium P. Furthermore, it is preferable to set the portion for irradiation to a prescribed size with consideration of the various discrepancies in the position of images (e.g. positions of images formed on each of the image carriers 7, and positions of images transferred from the image carriers 7 to the intermediary transfer member 1). This is to avoid heating of unnecessary areas, increasing the temperature of the intermediary transfer member 1, and consumption of energy for heating unnecessary areas. It is to be noted that the unfixed toner 6 on the intermediary transfer member 1 may be read with an optical sensor for determining the area for irradiating the laser beam L.

In a case where the laser beam L is irradiated to an area on which the toner 6 is disposed, the laser beam L energy is absorbed by the toner 6, thereby heating the toner 6. Meanwhile, in a case where the laser beam L is irradiated to an area on which the toner 6 is not disposed, the laser beam L transmits through the intermediary transfer member 1, being formed of light transmittable material, and is irradiated to the fixing roller 3. Since the fixing roller 3 is rotatively driven in compliance with the intermediary transfer member 1, the laser beam L does not concentrate on a particular part of the fixing roller 3. Therefore, minimal temperature rise occurs for a particular portion. Furthermore, since the surface layer of the fixing roller 3 is provided with a high reflectance material, the laser beam L is reflected in the direction of the intermediary transfer member 1, thereby allowing the toner 6 to be irradiated from the inner side of the intermediary transfer member 1. It is to be noted that since only a small amount of light energy can be absorbed when a light transmittable material is used as the intermediary transfer member 1, temperature rise of the intermediary transfer member 1 can be prevented effectively. Furthermore, since the side of the intermediary transfer member 1 on which the unfixed toner 6 is disposed is heated in a non-contact manner, a steady image quality can be attained without having to adversely affect the physical state of the toner 6. Since the toner 6 is heated from its surface, the heating temperature from the bottom side of the intermediary transfer member 1 can be set to be relatively low; thereby, temperature rise of the intermediary transfer member 1 can further be prevented.

Since the laser beam L is guided in the above-described manner, the laser beam L transmitting through the intermediary transfer member 1 will not be irradiated to other apparatuses and components in the image forming apparatus. Accordingly, other apparatuses and members can be prevented from being damaged by such irradiation. In addition, since the toner 6 on the intermediary transfer member 1 is heated from both sides, energy for heating can be used efficiently. Furthermore, the laser beam L can be further applied (re-reflected), for example, by disposing a reflection plate or a reflection member to a position corresponding to the path of the laser beam L being reflected from a rear side of the intermediary transfer member 1.

It is to be noted that although the above example describes a structure where the rollers 2, 3 are employed for reducing frictional force for the intermediary transfer member 1, other alternative structures may be employed as long as the intermediary transfer member 1 can be evenly contacted. Furthermore, a member for preventing the transmitted laser beam L from being irradiated to other members and components may be employed. For example, a white colored member may be used for diffusing the energy of the laser beam L.

Meanwhile, black toner (Bk), in general, is effective for heating since it has excellent light energy absorbability. On the other hand, color toners such as Yellow (Y), Magenta (M), and Cyan (C) relatively lack light energy absorbability. Therefore, an infrared absorbing agent is contained in the toners except for the black toner, to thereby increase efficiency in absorbing the irradiation energy of the laser beam L, and improve heating performance. That is, employing the infrared absorbing agent allows the temperature of the portion of the intermediary transfer member 1 surrounding the toner 6 to rise faster, and raise the temperature of the toner 6 efficiently. Therefore, transfer and fixation can be performed at high speed. Furthermore, by employing the above-described selective heating process, an image forming apparatus (color image forming apparatus), which does not require the heating of the entire intermediary transfer member 1, can be obtained. Furthermore, it is preferable to include crystalline polyester in the toner 6 so as to lower the softening point of the toner 6 and attain a sharp melt property for the toner 6. This enables the toner 6 to be adequately irradiated (heated) in a short amount of time.

Figure 3:
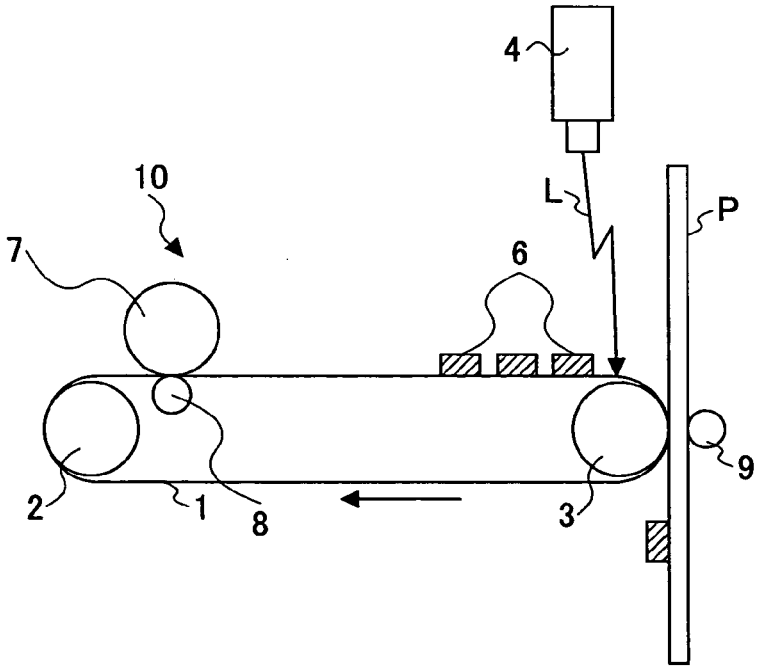
FIG. 3 is schematic diagram showing the image forming apparatus according to the first embodiment of the present invention in a case of outputting a monochrome image.
Figure 4:
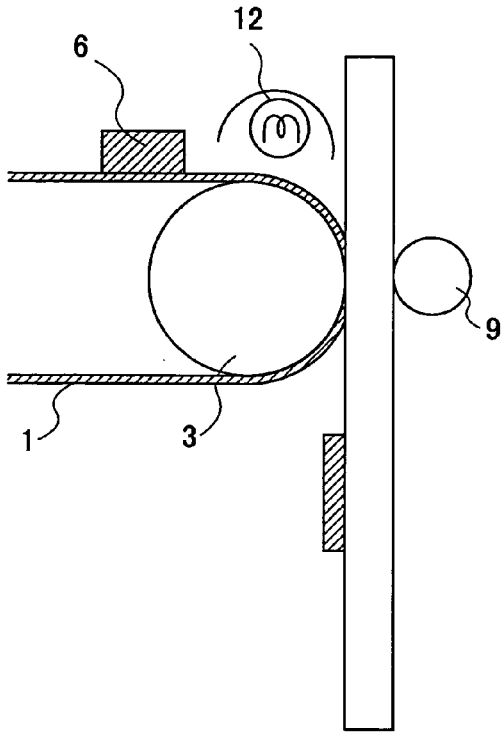
FIG. 4 is a partial cross-sectional view showing an alternative example according to the first embodiment of the present invention.

In a case where no infrared absorbing agent is included in the foregoing color toners, it is preferable to employ a light energy absorbable material with satisfactory light absorbability as the intermediary transfer member 1. By employing the light energy absorbable material as the intermediary transfer member 1, the intermediary transfer member 1 can be heated at a faster rate, and the heat of the intermediary transfer member 1 can be effectively propagated to the toner 6 for heating the toner 6. In this case, since the intermediary transfer member 1 is selectively heated at prescribed portions where the toner 6 is situated, temperature rise of the entire intermediary transfer member 1 can be prevented; thus the toner 6 can be heated in a short period of time, thereby being applicable to an increase in recording speed. In a case, for example, in FIG. 3, where the image forming apparatus only outputs monochrome images (i.e. black toner only), it is effective to employ a transparent member as the intermediary transfer member 1 so that temperature rise of the intermediary transfer member 1 can be prevented. Although the first embodiment employs the laser source 4 as the heating source, other alternative components may be employed for selectively heating the toner 6 disposed on the intermediary transfer member 1. For example, a plurality of lamps as heaters aligned in an orderly manner may be alternatively employed as the heating source. FIG. 4 is a partial cross-sectional view showing an alternative example where a flash lamp 12 is employed as the heating source.

[Second Embodiment]

Figure 5:
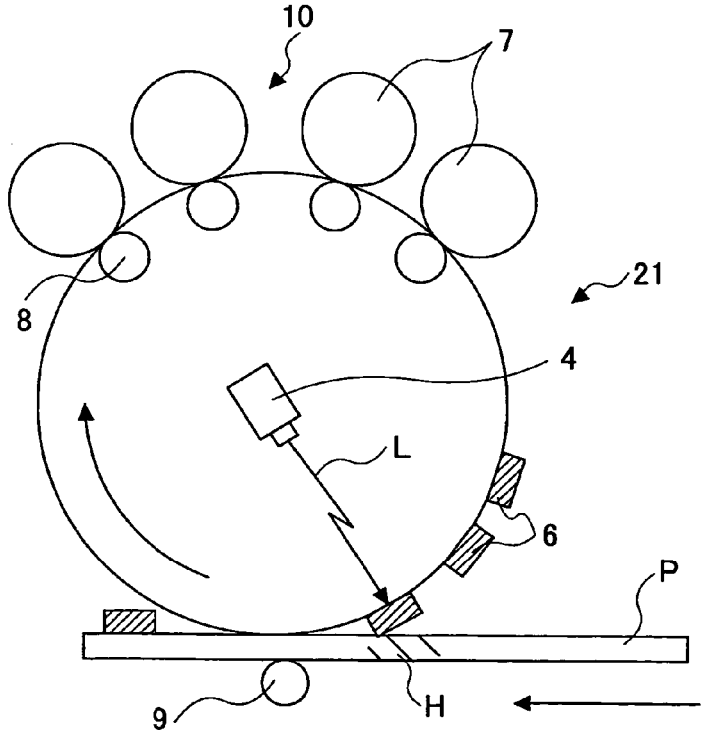
FIG. 5 is a schematic diagram showing an image forming apparatus according to a second embodiment of the present invention.

FIG. 5 is a schematic view showing an image forming apparatus according to a second embodiment of the present invention. The intermediary transfer member 21 of this embodiment is a transparent cylinder-shaped glass substrate coated by, for example, 10 μm of PFA (fluorine resin). The intermediary transfer member 21 is rotatively driven by a driving source (not shown). The components including the image forming unit 10, the image carriers 7, and the transfer rollers 8 are disposed around the intermediary transfer member 21 in a manner similar to that in the first embodiment. Furthermore, in a manner similar to that in the first embodiment, the recording medium P is conveyed to a compressing (contacting) part between the pressing roller 9 and the intermediary transfer member 21 via a conveyance path (not shown), thereby transferring the toner 6 on the intermediary transfer member 21 to the recording medium P.

The laser light source 4 is disposed at the inner periphery of the intermediary transfer member 21. The laser beam L, which is irradiated from the laser light source 4, is selectively irradiated to be incident in the vicinity of the portion at which the intermediary transfer member 21 (downstream part of rotating direction) contacts the pressing roller 9 (transfer portion, fixation portion).

Next, the heating method and operation according to the second embodiment of the present invention is described. The laser beam L is irradiated from a prescribed portion of the inner peripheral surface of the intermediary transfer medium 21, transmits through the intermediary transfer member 21 (formed of a transmittable material) and is incident on the toner 6, to thereby heat the toner 6. At the areas surrounding the toner 6, the permeating laser beam L is irradiated to the recording medium P, to thereby heat the surface of the recording medium P (diagonal line portion H in FIG. 5). The portion to be irradiated by the laser beam L is situated in the proximity of where the intermediary transfer member 21 contacts the recording medium P, and is located at the downstream part in the rotating direction of the intermediary transfer member 21. Therefore, the irradiation portion is a portion where the unfixed image part relatively overlaps the recording medium P. The irradiation portion of the intermediary transfer member 21, then, reaches the portion (nip portion) sandwiched between the intermediary transfer member 21 and the pressing roller 9. Then, the softened toner on the intermediary transfer member 21 penetrates into the fibers of the recording medium P by being pressed by the pressing roller 9, and is fixed thereto.

Similar to the first embodiment, since the toner 6 is heated and softened from its lower side (i.e. side toward the intermediary transfer member 21), the adhesive force with the intermediary transfer member 21 is weakened, thereby allowing the toner 6 to be transferred to the recording medium P more easily. Furthermore, since the surface of the recording medium P, which contacts the toner 6, is heated, a drastic drop in the temperature of the toner 6 can be prevented.

It is to be noted that such drastic drop of temperature causes the toner 6 to solidify before penetrating into the fibers of the recording medium P, and to reduce adhesiveness with respect to the recording medium P. This may cause the toner 6 to transfer insufficiently to the recording medium P. In order to avoid such problems, the toner 6 is to be heated sufficiently, and/or a sufficient pressing force is to be applied at the contacting portion between the toner 6 and the recording medium P. In this embodiment, by heating the portion of the recording medium P to which the toner 6 is to be transferred, the fibers at the portion of the recording medium P can be softened, thereby allowing the toner 6 to penetrate more easily and improve fixing performance.

Therefore, since the temperature of the toner 6 is not required to be raised by a considerably amount, the intermediary transfer member 21 can be prevented from overheating, thereby enabling light energy to be used efficiently. Furthermore, since a small amount of pressing force is required by the pressing roller 9 and since the intermediary transfer member 21 requires little rigidity, the intermediary transfer member 21 can be formed into a thin shape. This allows energy lost through heat permeation to be reduced. Accordingly, the amount of energy to be applied can be reduced. Hence, reduction of heat source capacity and component cost can achieved.

[Third Embodiment]

Figure 6:
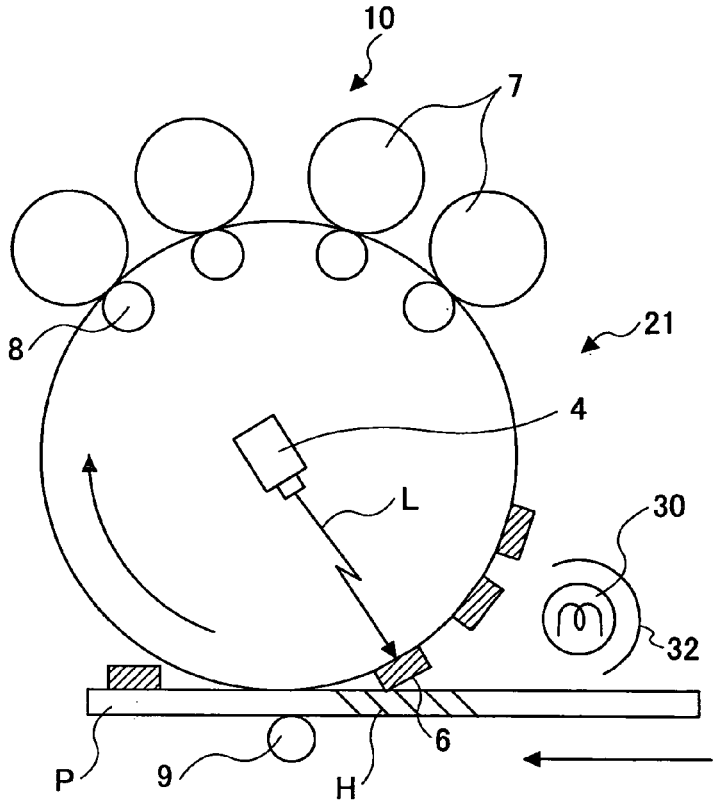
FIG. 6 is an image forming apparatus according to a third embodiment of the present invention.

FIG. 6 is a schematic drawing showing an image forming apparatus according to a third embodiment of the present invention. Since the disposition of this embodiment is similar to that of the second embodiment, only the different portions are described below.

In the third embodiment, a halogen lamp 30 is disposed at a portion contacting neither the intermediary transfer member 21 nor the recording medium P along the conveying direction of recording medium P, and is disposed to irradiate an area no less than the maximum recordable width in the axial direction. A reflection plate 32 is disposed so that reflected light from the halogen lamp 30 can be directed to a contacting portion between the pressing roller 9 and the intermediary transfer member 21.

In this embodiment, when the recording medium P is conveyed to a prescribed location, the light of the halogen lamp 30 is irradiated thereto as the recording medium P passes the prescribed location. At the same time, the laser beam L is selectively irradiated to the unfixed image on the intermediary transfer member 21, that is, to the toner 6 disposed at a prescribed area, so that the toner 6 can be heated. The irradiation from the halogen lamp 30 and the laser beam L enables the toner 6 to be heated from its lower and upper sides, and allows the surface of the recording medium P to be uniformly heated (portion H illustrated with diagonal lines in FIG. 6). Accordingly, the temperature of the heated toner 6 can be effectively prevented from drastically dropping when contacting the recording medium P. Furthermore, since the surface of the toner 6 contacting the recording medium is heated, the toner 6 is able to sufficiently penetrate into the fibers of the recording medium P. Hence, fixation performance can be improved. Furthermore, the pressing roller 9 of this embodiment also requires a small amount of pressing force, and the intermediary transfer member 21 of this embodiment requires little rigidity. Therefore, the intermediary transfer member 21 can be formed into a thin shape. This allows energy lost through heat permeation to be reduced. Accordingly, the amount of energy to be applied can be reduced. Hence, reduction of heat source capacity and component cost can be achieved.

In addition, since the toner 6 is not irradiated until the toner 6 reaches the prescribed area, the heating process is performed to an extent where the recording medium P passes the halogen lamp 30. Therefore, the intermediary transfer member 21 is not constantly heated. Furthermore, since a transmittable material is used for the intermediary transfer member 21, the temperature of the intermediary transfer member 21 can be substantially prevented from rising. In addition, since the recording medium P, having a large thermal capacity, serves to absorb heat when contacting the intermediary transfer member 21 at its irradiated areas (transfer and fixation portion), the temperature of the intermediary transfer member 21 can be further prevented from rising. Since the toner 6 has its upper portion heated by the halogen lamp 30 and its lower portion heated by the laser beam L, the toner 6 can be heated in a short period of time, thereby being applicable to an increase in recording speed.

It is to be noted that it is preferable to allow a toner transferred portion to contact a member having a large thermal capacity, and/or to be cooled by cooling air circulating through the inside of the image forming apparatus, for example.

[Fourth Embodiment]

Figure 7:
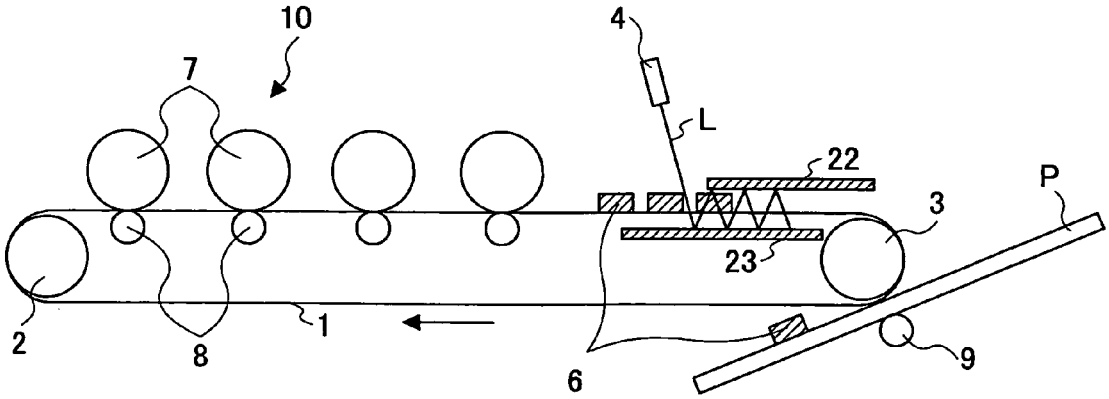
FIG. 7 is an image forming apparatus according to a fourth embodiment of the present invention.

FIG. 7 is a schematic view showing an image forming apparatus according to a fourth embodiment of the present invention. In this embodiment, in a case where a light energy permeable material (permeable to heat) is used for the intermediary transfer member 21, protection members 22, 23 are situated in a direction corresponding to the direction where the laser source 4 heats the toner 6 (intermediary transfer member 21). By such disposition, other components can be prevented from being thermally damaged by the light energy permeating through the intermediary transfer member 21.

Such thermal damage may further be prevented by using diffusing reflection members as the protection members 22, 23, so that the light L can be diffused and have its energy reduced. In addition, by using the diffusing reflection members as the protection members 22, 23, the light reflected from the protection members 22, 23 (diffusing reflection members) can be irradiated again to the toner 6, thereby effectively using the energy from the light permeating through the intermediary transfer member 1. Furthermore, since the light L reflected via the protection members 22, 23 can be irradiated from the side of the intermediary transfer member 6 which is opposite from the side where the toner 6 is disposed (inner side of the intermediary transfer member 21 in FIG. 7, for example), the permeated light energy serves to heat the intermediary transfer member 21. This allows the recording medium P to be heated, thereby reducing the temperature difference between the recording medium P and the toner 6. Hence, the temperature of the toner 6 can be prevented from sharply dropping upon contacting the recording medium P, thereby allowing the toner 6 to penetrate into the fibers of the recording medium P more easily, and to be fixed to the recording medium more efficiently.

Figure 8:
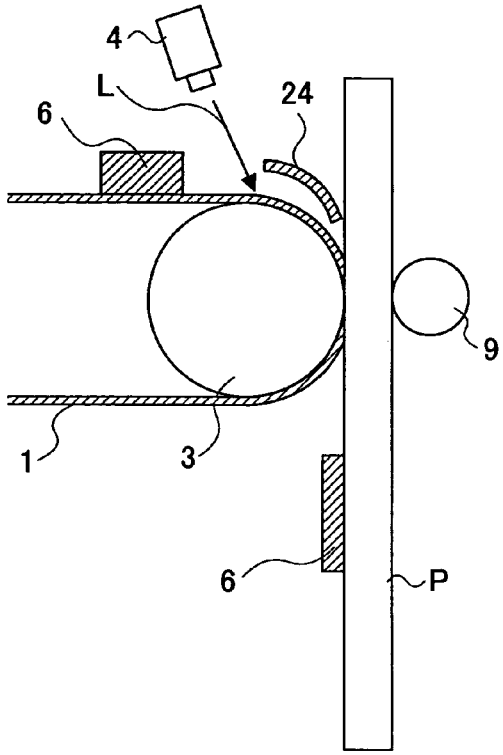
FIG. 8 is a partial cross-sectional view showing an alternative example according to the fourth embodiment of the present invention.

FIG. 8 is a partial cross-sectional view showing a modified example of the image forming apparatus according to the fourth embodiment of the present invention. In this example, a bent reflection plate 24 is employed for using its bent shape to effectively reflect light onto prescribed portions of the intermediary transfer member 1.

[Fifth Embodiment]

Figure 9:
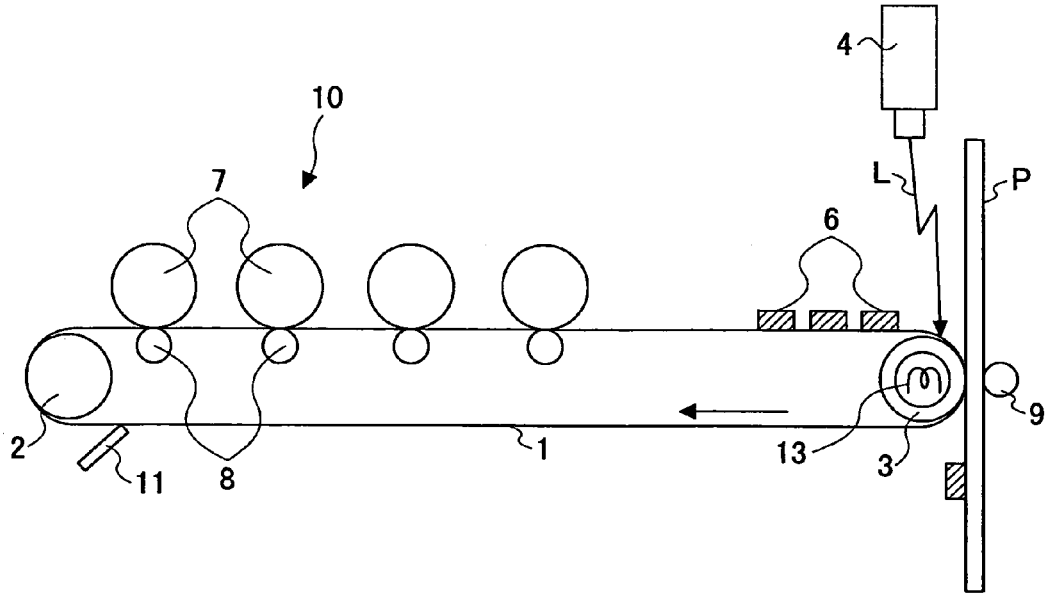
FIG. 9 is an image forming apparatus according to a fifth embodiment of the present invention.

FIG. 9 is a schematic view showing an image forming apparatus according to a fifth embodiment of the present invention. Although the image forming apparatus in this embodiment has a structure similar to the image forming apparatus of the first embodiment of the present invention, a halogen lamp 13 is disposed within the fixing roller 3, so that the intermediary transfer member 1 can be heated from both sides. The halogen lamp 13 applies heat, in synchronization with the unfixed toner 6 on the intermediary transfer member 1, entirely in the axial direction of the fixing roller 3. In this embodiment, since the intermediary transfer medium 1 is not heated entirely in the peripheral length direction of the intermediary transfer medium 1, the intermediary transfer member 1 can be prevented from being overheated. Since the toner 6 disposed on the intermediary transfer member 1 is selectively heated from both sides of the intermediary transfer medium 1, the temperature required for heating the intermediary transfer medium 1 can be lowered.

[Sixth Embodiment]

Figure 10:
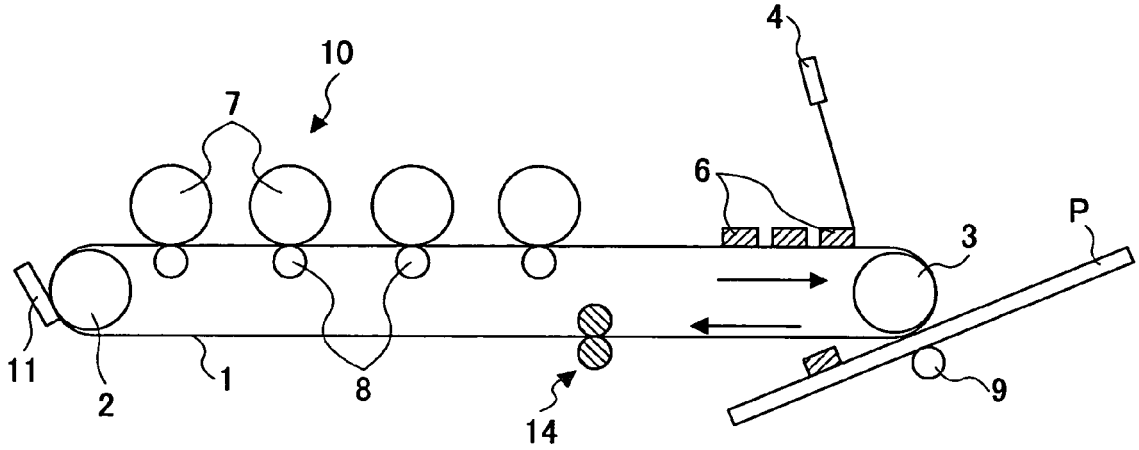
FIG. 10 is an image forming apparatus according to a sixth embodiment of the present invention.

FIG. 10 is a schematic view showing an image forming apparatus according to a sixth embodiment of the present invention. Although the image forming apparatus in this embodiment also has a structure similar to the image forming apparatus of the first embodiment of the present invention, a cooling roller 14 is disposed on downstream of the fixing roller 3 in the rotating direction of the intermediary transfer member 1. The cooling roller 14 serves to quickly lower the temperature of the intermediary transfer member 1 and helps to increase recording speeding. It is to be noted that the cooling roller 14 may also be added to the above-described embodiments.

[Seventh Embodiment]

Figure 11A:
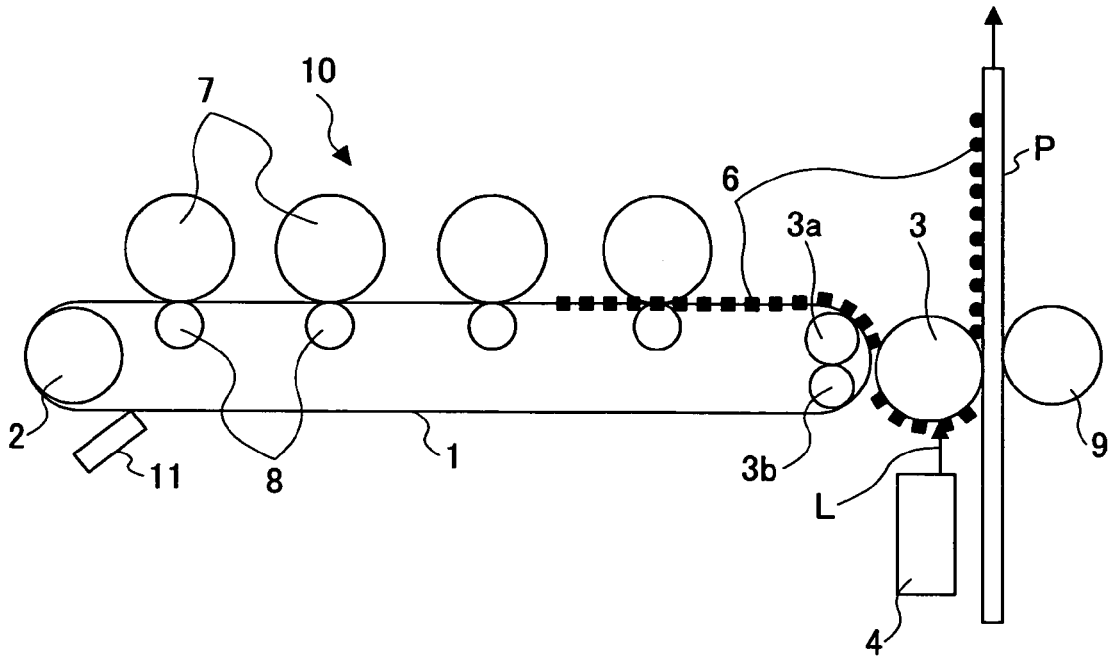
FIGS. 11A and 11B are schematic diagrams showing an image forming apparatus according to a seventh embodiment of the present invention.
Figure 11B:
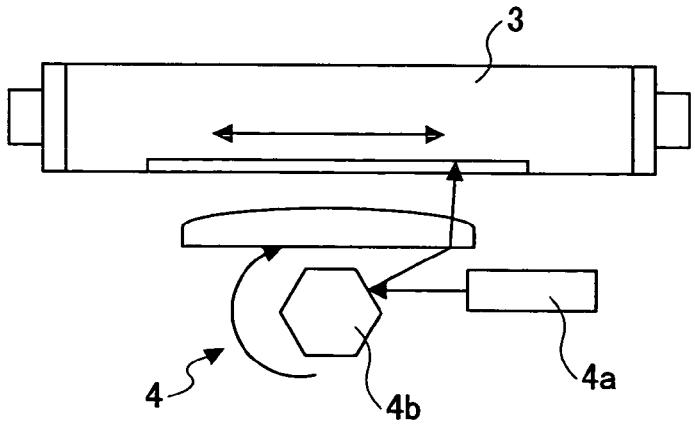

FIGS. 11A and 11B are schematic views showing an image forming apparatus according to a seventh embodiment of the present invention. The image forming apparatus in this embodiment employs a secondary transfer technique, wherein the toner 6 is not selectively heated on the intermediary transfer member 1, but on the fixing roller 3, by the laser source 4, after being transferred thereto. Since heating is performed in the vicinity of a nip portion of the fixing roller 3 at the upstream side of the rotating fixing roller 3, heat will only be released (transferred) from the toner 6 for a short period of time. Therefore, the temperature of the toner 6 can be effectively prevented from being decreasing. It is to be noted that the intermediary transfer member 1 is supported by a driving roller 2 and a pair of secondary transfer rollers 3*a*, 3*b*, wherein the fixing roller 3 and the intermediary transfer member 1 perform a secondary transfer of the toner 6.

Similar to the foregoing embodiments, this embodiment also performs transfer and fixation to the recording medium P in a manner where a larger amount of heat is applied to a prescribed area with an unfixed image than a portion without an unfixed image. Here, the laser beam L is irradiated to the toner 6 on the fixing roller 3 for heating (softening) the toner 6. Then, by conveying and pressing the recording medium P between the fixing roller 3 and the pressing roller 9, the toner 6 penetrates into the fibers of the recording medium P. A bias circuit (not shown) is employed to apply the necessary voltage for the first transfer performed with the fixing roller 8, and the second transfer performed with the pair of secondary transfer rollers 3*a*, 3*b*.

[Eighth Embodiment]

Figure 12:
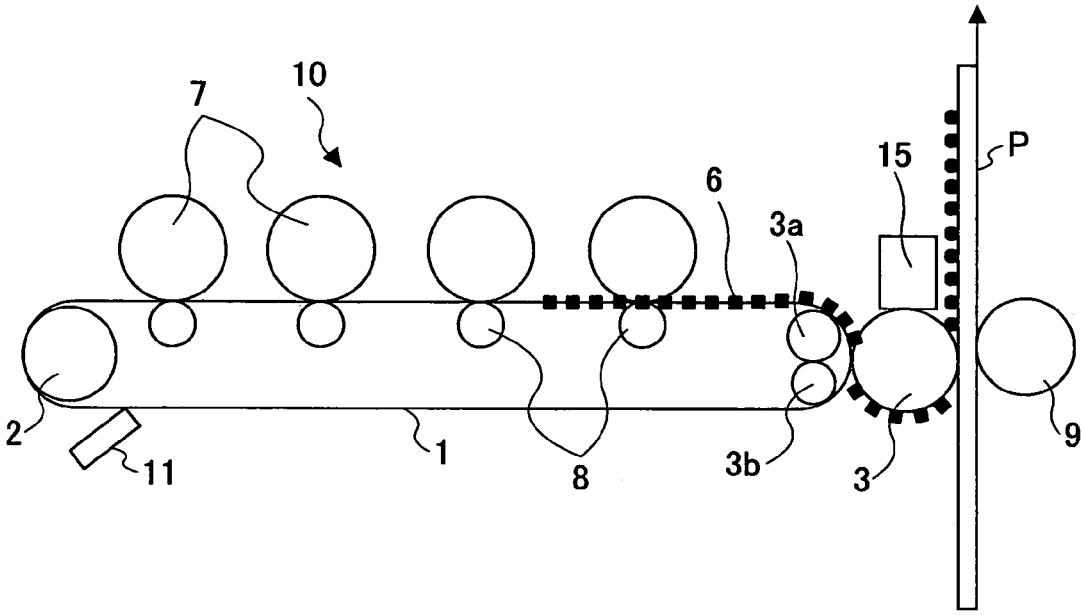
FIG. 12 is an image forming apparatus according to an eighth embodiment of the present invention.

FIG. 12 is a schematic view showing an image forming apparatus according to an eighth embodiment of the present invention, wherein a thermal head 15 is employed as a heating source (contact type heating source) that contacts the toner 6 disposed on the intermediary transfer member 1. Although it is difficult to heat unfixed toner with a contact type heating source (in this embodiment, the thermal head 15), this embodiment employs a technique in which portions (areas) of the fixing roller 3 are selectively heated before the toner 6 is transferred from the secondary transfer rollers 3*a*, 3*b* to the fixing roller 3 (secondary transfer). Since the toner 6 is situated at portions of the intermediary transfer member 1 that correspond (match) with the heated portions of the fixing roller 3, the intermediary transfer member 1 does not contact the highly heated portions of the fixing roller 3. Therefore, the temperature of the intermediary transfer member 1 can be prevented from rising.

Figure 13:
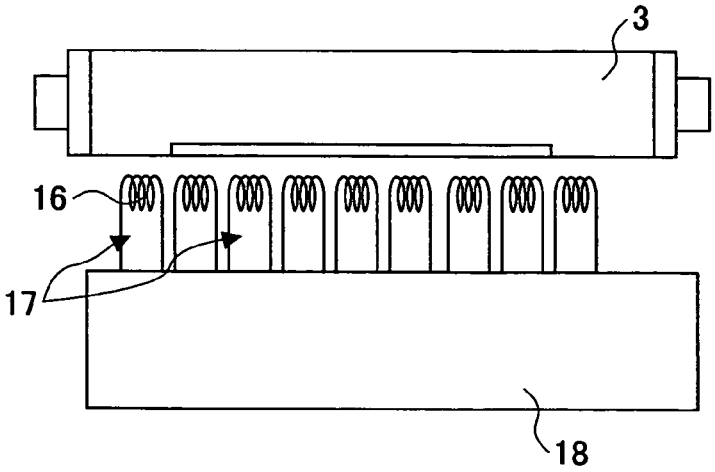
FIG. 13 is a schematic diagram showing an alternative selective heating unit according to an embodiment of the present invention.

As described with the seventh and eighth embodiments, other heating sources (heating components) may be used for selectively heating prescribed portions where the toner 6 is disposed. For example, as shown in FIG. 13, a plurality of heaters 17 provided with filaments 16 may be employed as the heating source (selective heating source), wherein each heater 17 is switched on and off in correspondence with the position of the unfixed toner (unfixed image) in performing the selective heating.

Figure 14:
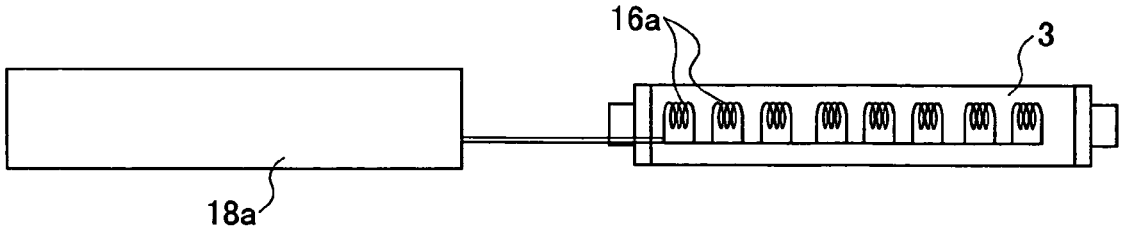
FIG. 14 is a schematic diagram showing another alternative selective heating unit according to an embodiment of the present invention.

Alternatively, as shown in FIG. 14, a plurality of induction heating coils 16*a* may be employed as the heating source (selective heating source), wherein each induction heating coil 16*a* is switched on and off in correspondence with the position of the unfixed image in performing the selective heating. The fixing roller 3, having a conductive layer situated in the vicinity of its surface layer, uses the conductive layer to perform heating with induced current. The induction heating coils 16*a* may be disposed inside or outside of the fixing roller 3. Furthermore, although a plurality of wires may be employed for switching the induction heating coils 16*a*, the induction heating coils 16*a* may, alternatively, be switched by adjusting impedance (for example, by using a condenser) and switching frequency so that each induction heating coil 16*a* can have a different resonance frequency (such as the example shown in Japanese Laid-Open Publication No. 2003-017237).

[Ninth Embodiment]

Figure 15A:
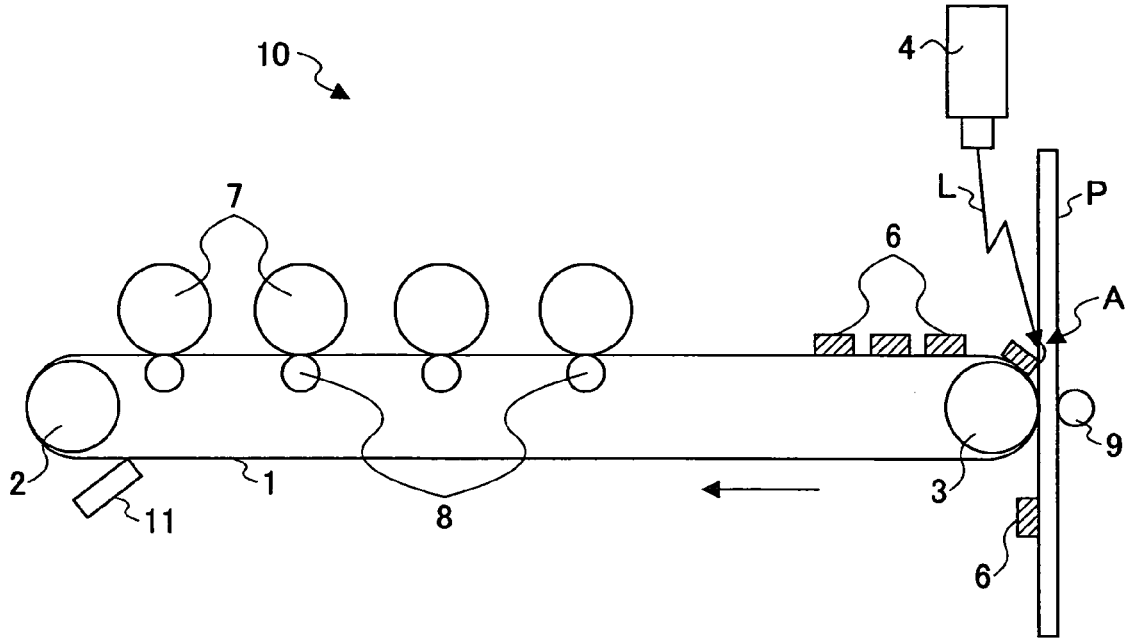
FIG. 15A is a schematic diagram showing an image forming apparatus according to a ninth embodiment of the present invention.
Figure 15B:
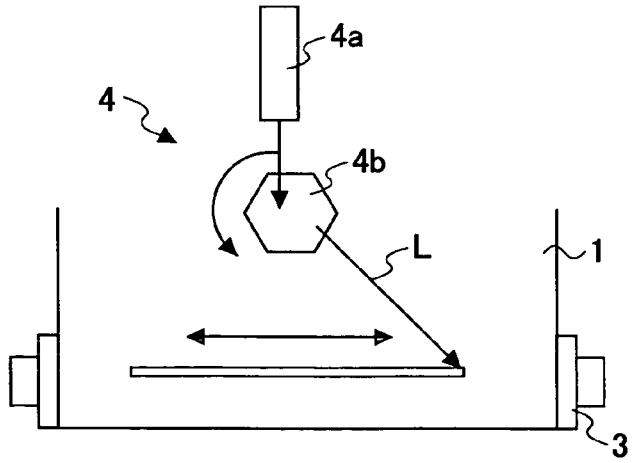
FIG. 15B is a partial plan view showing the image forming apparatus according to the ninth embodiment of the present invention.
Figure 16:
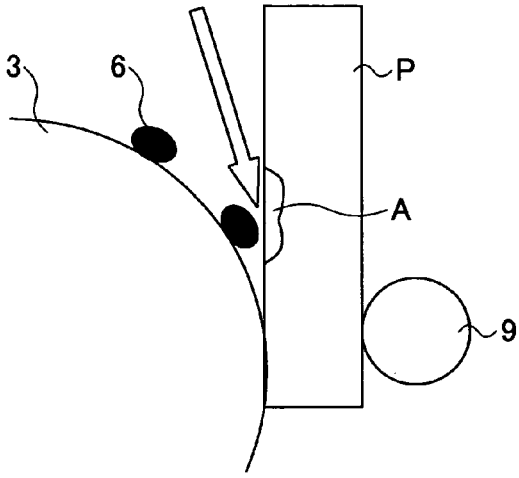
FIG. 16 is a cross-sectional view showing a portion to which a laser beam is irradiated according to the ninth embodiment of the present invention.

FIG. 15A is a schematic view showing an image forming apparatus according to a ninth embodiment of the present invention, and FIG. 15B is a partial plan view showing the image forming apparatus according to the ninth embodiment of the present invention. Furthermore, FIG. 16 is a cross-sectional view for explaining the irradiation of a laser beam according to the ninth embodiment of the present invention. Since the basic structure of the image forming apparatus according to the ninth embodiment is similar to that of the image forming apparatus according to the first embodiment, detailed description for similar parts is omitted.

In this embodiment, as shown in FIG. 15A, the laser source 4 is disposed above the fixing roller 3. The laser L is irradiated from the laser source 4 for selectively heating, correspondingly (synchronously) with the toner 6 (unfixed toner) conveyed by the intermediary transfer member 1, the prescribed portions of the recording medium P in a width direction of the fixing roller 3 (see FIG. 15B), which width direction perpendicularly intersects with the conveyance direction of the recording medium P.

More specifically, the laser beam L from the laser source 4 is selectively irradiated to the surface of the recording medium P at an upstream part with respect to the rotation of the fixing roller 3 (upstream with respect to the conveyance direction of the recording medium P) and thus in the vicinity of the contacting portion between the fixing roller 3 and the intermediary transfer member 1. The letter A in FIG. 15A and FIG. 16 illustrates the portion irradiated by the laser source 4. Information from an exposing part (not shown) for irradiating light to the image carriers 7 is used in the irradiation of the laser beam L, wherein a control part of the image forming apparatus (not shown), in accordance with the information, determines to perform the irradiation when an unfixed image (unfixed toner) is disposed at a prescribed part of the intermediary transfer member 1, and determines not to perform the irradiation when no unfixed image (unfixed toner) is disposed on the prescribed part of the intermediary transfer member 1. In accordance with the results of the determination, the laser beam L is irradiated to the recording medium P (starting from its tip portion) correspondingly with the portions of the intermediary transfer member where the unfixed image (unfixed toner) is disposed. That is, the irradiation is performed in correspondence with the exposed portions of the image carriers 7 with respect to main and sub scanning directions. Accordingly, the intermediary transfer member 1 need not to be heated entirely. This prevents fusion at the development part and/or toner blocking caused by wear of the intermediary transfer member 1 or by the rise of temperature inside the image forming apparatus. Accordingly, a steady output of images can achieved. Furthermore, since the heated portion is situated in the vicinity of the contacting portion between the fixing roller 3 and the intermediary transfer member 1 and thus at the upstream part with respect to the rotation of the fixing roller 3, the heat of the heated recording medium P is transferred (escapes) for only a short period of time. This effectively prevents the temperature of the recording medium P from falling.

The same as the above-described embodiments of the present invention, the spot diameter of the laser beam L has a size satisfying the size (area) of the irradiation portion indicated with the letter A. For example, in a case where the latent recording pixel corresponds to 600 dpi resolution, the irradiation may be performed with a larger size (area) such as corresponding to 72 dpi resolution. That is, since the irradiation is performed, in plural separate irradiation portions A on the recording medium P, with an irradiation size larger than the pixel size of the minimal resolution for recording an image with the image forming apparatus, the irradiation can be performed to suffice for variations (differences) in the accuracy of positions with respect to the position of the toner 6 and the heating portion. Therefore, heating can be performed steadily. Although temperature rise of the intermediary transfer member 1 can be prevented more effectively by irradiating and heating with a laser beam having a small spot diameter, the irradiation portion A can be irradiated with more consistency by employing a laser beam having a spot diameter which is larger than the latent recording pixel. Furthermore, by enlarging the spot diameter, the toner 6, when approaching the proximity of portion A, can be heated and irradiated by the laser beam L.

Next, the operation of transferring and fixing the toner 6 to the recording medium P is described. The toner 6 is heated by contacting the irradiation portion A of the heated (irradiated) recording medium P. The toner 6 is also heated by being directly irradiated by the laser beam L. After the toner 6 is softened due to the heating, the pressing roller 9 presses against the conveyed recording medium P for allowing the toner 6 to penetrate into the fibers of the recording medium P. Thereby, the toner 6 is transferred and fixed to the recording medium P.

Since transfer and fixation of the toner 6 is performed in such a manner, it is preferable to irradiate the laser beam L to the recording medium P in the vicinity of where the toner 6 is transferred, so that the time duration for loss of temperature of the portion A of the recording medium P (i.e. the time for the toner 6 to reach the recording medium P) can be reduced (e.g. 10 through 100 ms). Since the size (area) of irradiation is set to be sufficient for the variation (difference) in the formation of the latent image of the image carriers 7 and the position in transferring the toner 6 to the intermediary transfer medium 1, the heating of unnecessary portions can be prevented, the rise of temperature of the intermediary transfer member 1 can be prevented, and unnecessary energy for heating portions other than the irradiation portion A can be reduced. It is to be noted that the unfixed toner 6 on the intermediary transfer member 1 can be read by an optical sensor for determining the area (portion) for determining the irradiation of the laser beam L.

The laser beam L, being irradiated to the portion of the intermediary transfer member 1 on which the toner 6 is situated, has its energy absorbed by the toner 6, thereby heating the toner 6. The laser beam L, being irradiated to other areas (portions), is directly irradiated to the recording medium P. Since the intermediary transfer member 1 is made of a transmittable material, the laser beam L having been incident on the intermediary transfer member 1 transmits through the intermediary transfer member 1 and is incident on the fixing roller 3. Since the fixing roller 3 is rotatably driven in compliance with the intermediary transfer member 1, the irradiation is not concentrated on a particular portion of the fixing roller 3. Therefore, such irradiation causes minimal temperature rise for a particular portion. Since the surface of the fixing roller 3 is provided with a high reflectance material, the laser beam L is reflected back to the intermediary transfer member 1, thereby irradiating (heating) the toner 6 from the inner side of the intermediary transfer member 1. It is to be noted that since the intermediary transfer member 1 can attain a low light energy absorptivity by employing a transmittable material as the intermediary transfer member 1, the temperature rise of the intermediary transfer member 1 can be effectively prevented. Furthermore, since the toner 6 (unfixed image) disposed on the intermediary transfer member 1 is heated in a non-contact manner, the physical state of the toner 6 will not be adversely affected, thereby a steady image quality can be obtained. Since the toner 6 is heated beginning from its surface, the temperature for heating the toner 6 from the bottom of the intermediary transfer member 1 can be reduced, thereby temperature rise of the intermediary transfer member 1 can be prevented more effectively.

[Tenth Embodiment]

Figure 17:
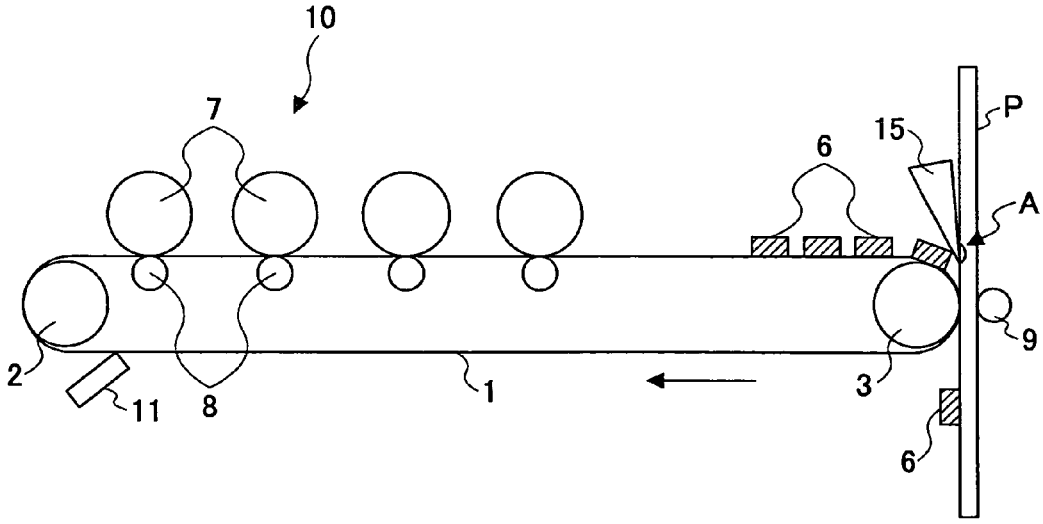
FIG. 17 is an image forming apparatus according to a tenth embodiment of the present invention.

FIG. 17 is a schematic view showing an image forming apparatus according to a tenth embodiment of the present invention. In this embodiment, as an alternative of the laser source 4 described in the ninth embodiment, a thermal head 15, for example, is employed as a heating source (contact type heating source), wherein the thermal head 15 is disposed in a manner contacting or proximal to the recording medium P. It is to be noted that the inventors of the present invention found that a satisfactory thermal efficiency can also be attained with the thermal head 15 by disposing the thermal head 15 as close as possible to the portion where the toner 6 is transferred. This owes to the fact that thermal head 15 is pressed against the recording medium P without loss of heat at its surface or its interface with the toner 6.

Unlike the case of using a non-contact heating source such as the laser source 4 in the ninth embodiment, it is difficult to directly heat the unfixed toner 6 by using a contact type heating source such as the thermal head 15. Nevertheless, a contact type heating source such as the thermal head 15 may alternatively be employed by selectively heating the recording medium P, beforehand, at portions where the toner 6 is to be transferred.

[Eleventh Embodiment]

Figure 18:
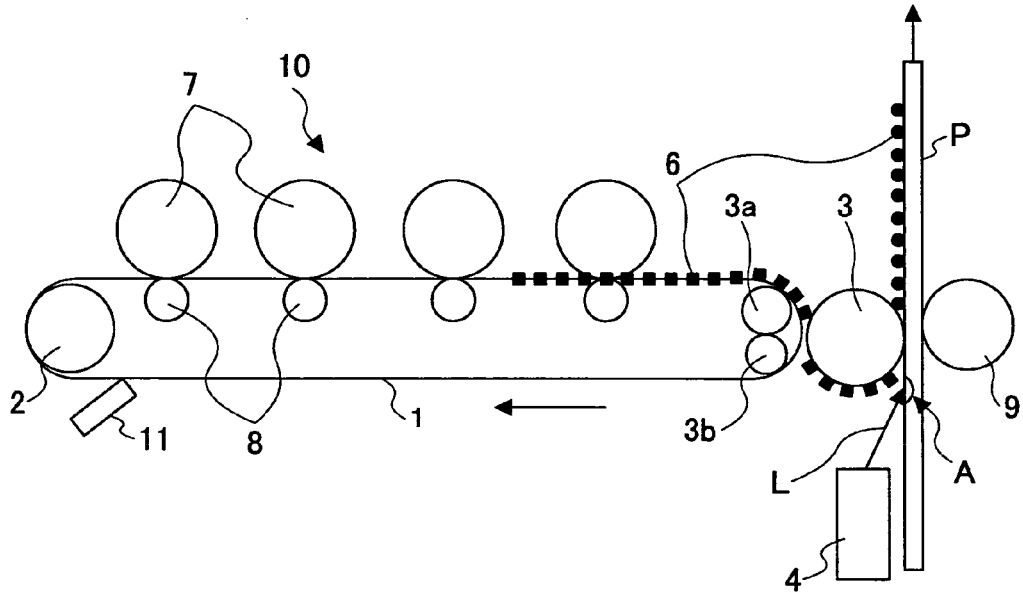
FIG. 18 is an image forming apparatus according to an eleventh embodiment of the present invention.

FIG. 18 is a schematic view showing an image forming apparatus according to an eleventh embodiment of the present invention. This embodiment employs the above-described secondary transfer technique, wherein the toner 6 on the intermediary transfer member 1 is transferred to the fixing roller 3, and then further transferred to the recording medium P. This embodiment, similar to the first embodiment, disposes the laser source 4 above the fixing roller 3 from which the laser beam L is irradiated so as to selectively heat the toner 6 (unfixed image) in the width direction of the fixing roller 3 that perpendicularly intersects the conveyance direction of the recording medium P. More specifically, similar to the first embodiment, the laser beam L from the laser source 4 is selectively irradiated to the surface of the recording medium P at an upstream part with respect to the rotation of the fixing roller 3 (upstream with respect to the conveyance direction of the recording medium P) and thus in the vicinity of the contacting portion (i.e. as close as possible to the nipping portion) between the fixing roller 3 and the recording medium P. Since the target heating portion is situated in the proximity of the nipping portion between the fixing roller 3 and the recording medium P and thus at the upstream part with respect to the rotation of the fixing roller 3, the period in which heat is transferred (escapes) from the heated recording medium P can be reduced to a considerably short amount of time. This effectively prevents the temperature of the recording medium P from falling. It is to be noted that the intermediary transfer member 1 is supported across by the driving roller 2 and the pair of secondary transfer rollers 3*a*, 3*b*, wherein a secondary transfer of the toner 6 is performed having the intermediary transfer member 1 disposed between the pair of secondary transfer rollers 3*a*, 3*b* and the fixing roller 3.

Similar to the above-described embodiments according to the present invention, the eleventh embodiment also transfers and fixes the toner 6 to the recording medium P by controlling the amount of heat, wherein a larger amount of heat is applied to a prescribed portion with an unfixed image than a portion without an unfixed image. Here also, the laser beam L is irradiated to the proximity of the nipping portion of the fixing roller 3 for heating and softening the toner 6. Then, by conveying and pressing the recording medium P between the fixing roller 3 and the pressing roller 9, the toner 6 penetrates into the fibers of the recording medium P. A bias circuit (not shown) is employed to apply the necessary voltage for the first transfer performed with the fixing roller 8, and the second transfer performed with the pair of secondary transfer rollers 3*a*, 3*b*. Furthermore, since the portions of the recording medium P to which the toner image is to be transferred are selectively heated beforehand, the intermediary transfer member 1 does not contact the highly heated portions of the transfer member 1. Therefore, the temperature of the intermediary transfer member 1 can be prevented from rising.

[Twelfth Embodiment]

Figure 19:
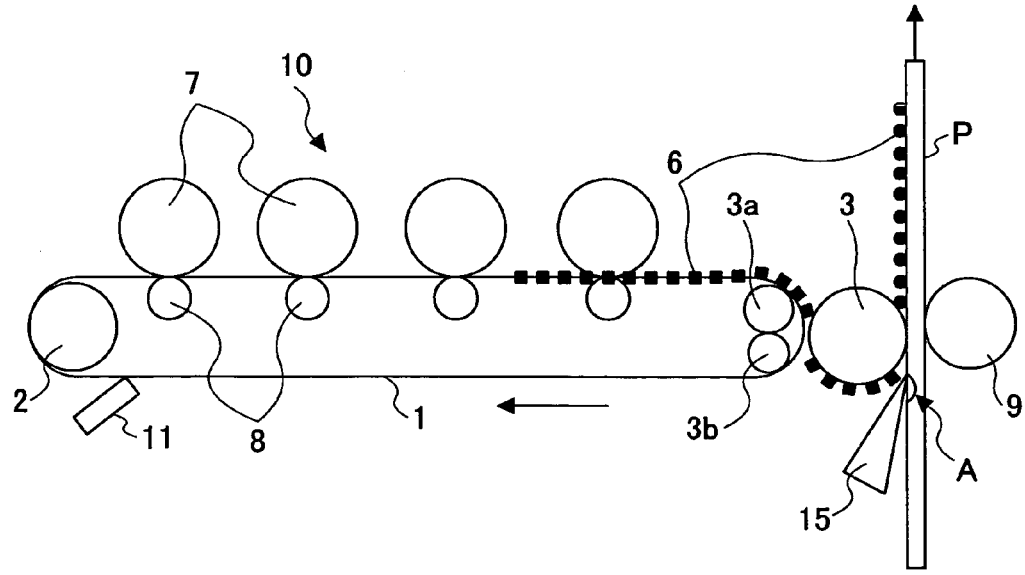
FIG. 19 is an image forming apparatus according to a twelfth embodiment of the present invention.

FIG. 19 is a schematic view showing an image forming apparatus according to the twelfth embodiment of the present invention. This embodiment also employs the secondary transfer technique, wherein the thermal head 15 is employed as the heating source that contacts the recording medium P. Description of like components with respect to the second and third embodiments according to the present invention are omitted.

It is to be noted that other components, which are capable of selectively heating the recording medium P at prescribed portions corresponding the toner 6, may alternatively be employed as the heating source. The heating source is neither limited to the aforementioned laser source 4 nor the thermal head 15. For example, a plurality of heaters provided with filaments may serve as the heating source, wherein selective heating is performed by a switching circuit that switches each heater on and off in correspondence to the position of the unfixed images.

It is also to be noted that although the above-described embodiments according to the present invention employ the fixing roller 3 as a fixing member, a belt type fixing member (belt member) may alternatively be employed as the fixing member.

It is preferable to employ an overall heating source in combination with the selective heating source for heating an entire area including non-image portions. For example, in some cases, a laser heating source may provide a mere thermal conversion efficiency of approximately 10 to 20%, while a halogen heating source or an induction heating source may provide a thermal conversion efficiency of 70 to 80%. It is preferable to determine the total electrical power based on the fractional rate of the selective heating source and the overall heating source. Furthermore, since a prescribed amount of thermal energy is required for softening the toner 6, the sum of the energy of the selective heating source and the overall heating source is required to measure up to the required amount of thermal energy. Accordingly, energy can be saved by increasing the energy proportion for the selective heating source for an image forming apparatus in a case of low image proportion (even if thermal conversion efficiency is low), and by increasing the energy proportion for the overall heating source for an image forming apparatus in a case of high image proportion.

Furthermore, the recording medium P may be heated not only from one side, but also from the other side with respect to the corresponding portions of the recording medium P.

Figure 20B:
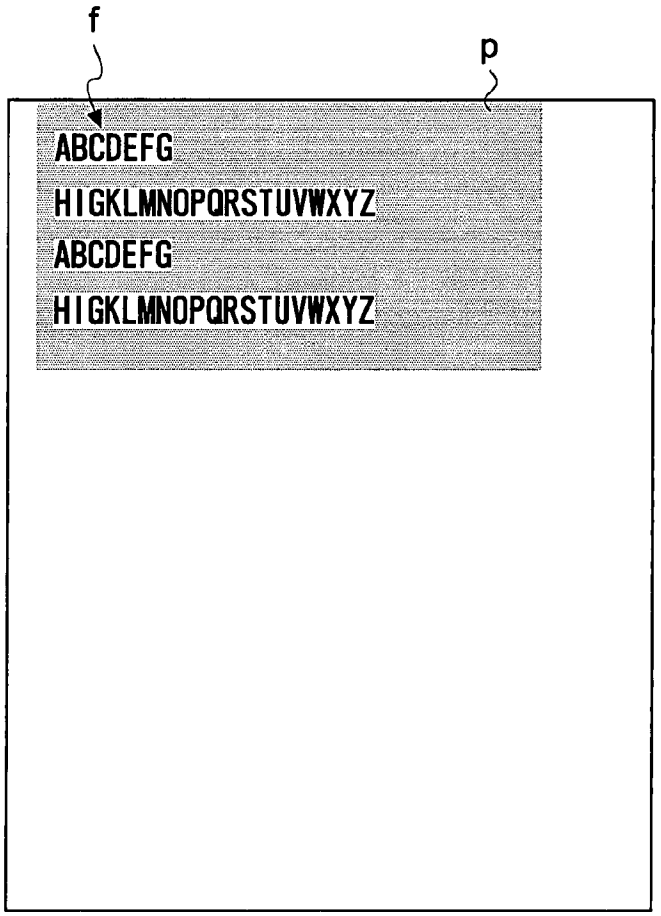
FIG. 20B is a schematic diagram showing a tracking pattern according to an embodiment of the present invention.
Figure 20A:
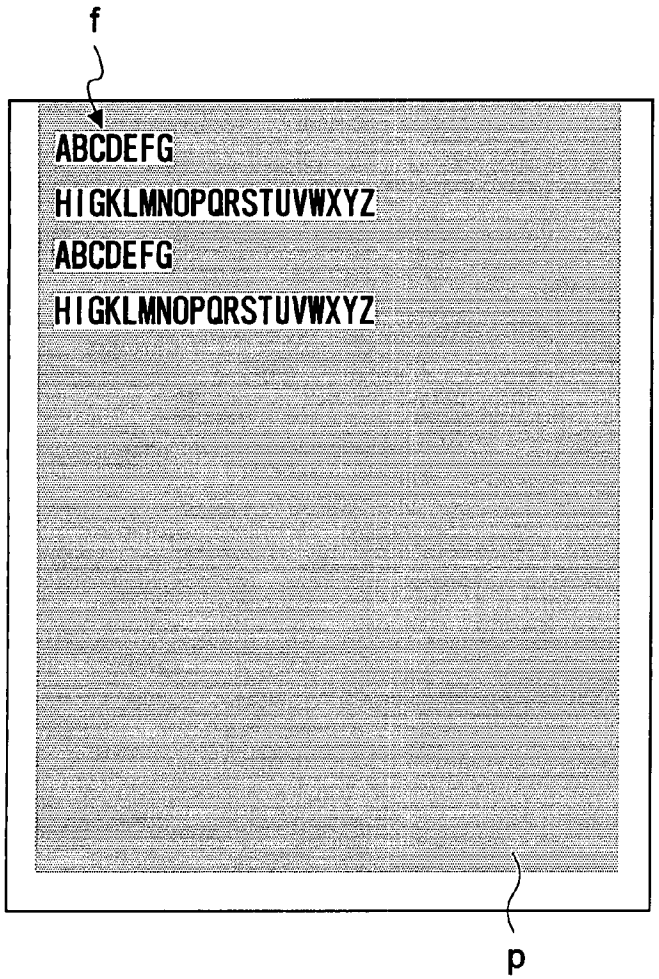
FIG. 20A is schematic diagram showing a tracking pattern according to a conventional example.

FIG. 20A is a schematic drawing showing a tracking pattern formed by overall heating and FIG. 20B is a schematic drawing showing a tracking pattern formed by selective heating. In the drawings, the letter f indicates an image portion, and the letter p indicates a tracking pattern formed, for example, with yellow toner. Conventionally, in many cases, tracking patterns are formed in areas (portions) including non-image portions (see FIG. 20A). This is due to the fact that the conventional image forming apparatus is based on overall heating. In a case of selective heating in a low resolution, the tracking pattern p is formed only at the area surrounding the image portion f (see FIG. 20B). Therefore, selective heating is beneficial from the aspect of energy saving. This is effective not only for the above-described secondary transfer technique, but for other fixing (transfer) techniques performing selective heating. For example, since the tracking pattern p is formed at the area surrounding the image portion f, the tracking pattern p may be used not only for the purpose of saving energy, but also for crime prevention purposes. An exemplary technology of printing tracking patterns for preventing counterfeiting is disclosed in Japanese Laid-Open Patent Application No. 2002-010057.

Figure 21B:
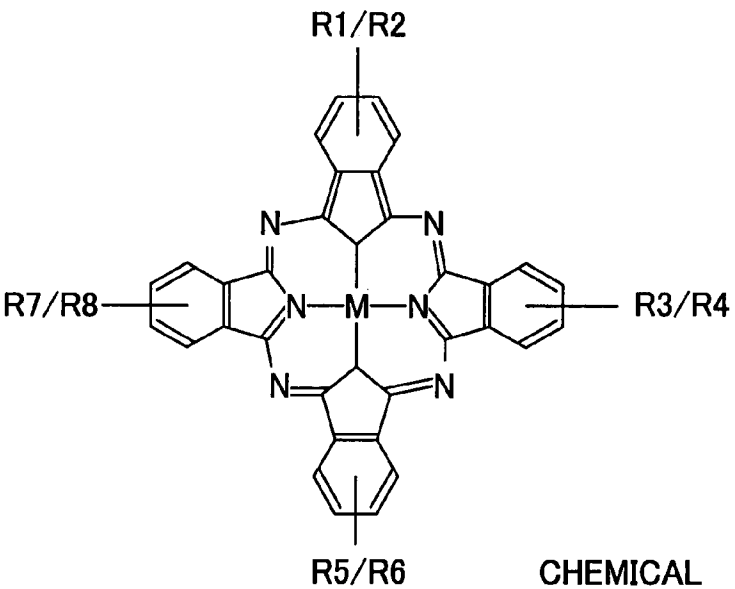
FIGS. 21A and 21B are schematic diagrams showing chemical structures of an infrared absorbing agent.
Figure 21A:
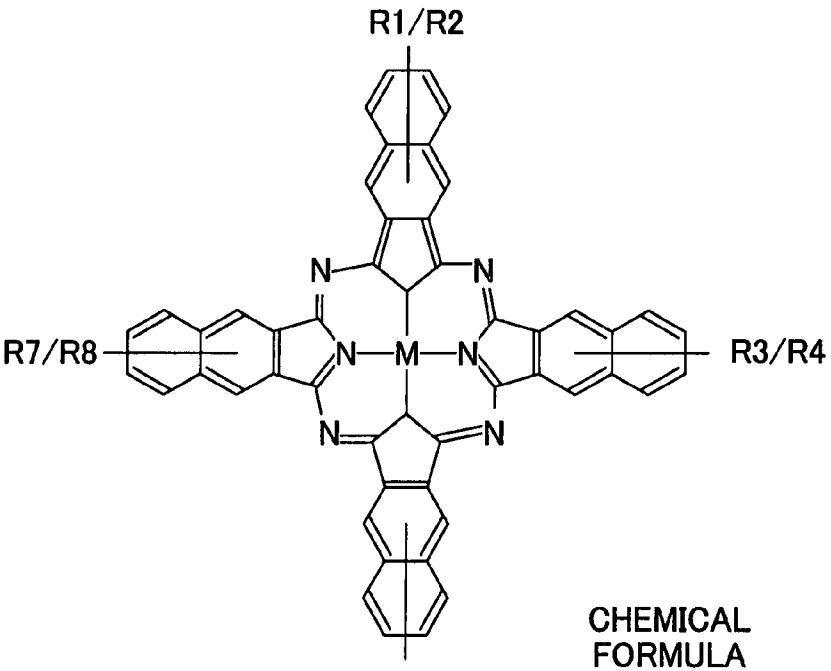

FIGS. 21A and 21B show an exemplary chemical structure of an infrared absorbing agent. The infrared absorbing agent is disclosed, for example, in Japanese Laid-Open Patent Application No. 2002-357927. It is to be noted that R1 through R8 in the chemical formulas shown in the drawings are substituents added to a benzene ring or a naphthalene ring, and are indicative of a hydrogen atom, a halogen atom, a saturated or unsaturated hydrocarbon group with carbon numbers from 1 through 18, or an organic group containing 1 through 13 carbon atoms, hydrogen atoms, and an oxygen and/or nitrogen atom, and M is indicative of two hydrogen atoms, a divalent metal ion, or a trivalent through tetravalent metal derivative.

Further, the present invention is not limited to these embodiments, but various variations and modifications may be made without departing from the scope of the present invention.

The present application is based on Japanese Priority Application Nos. 2003-182338 and 2004-078347 filed on Jun. 26, 2003 and Mar. 18, 2004, respectively, with the Japanese Patent Office, the entire contents of which are hereby incorporated by reference.

What is claimed is:

1. An image forming apparatus, comprising:

a transfer member for carrying a toner image on a surface thereof and transferring the toner image to a recording medium; and a heating unit for selectively heating the toner image on the surface of the transfer member in a width direction of the transfer member, the width direction of the transfer member perpendicularly intersecting the direction in which the toner image is conveyed;

wherein the heating unit is configured to separately heat plural heating parts of the transfer member in an axial direction in a range larger than a minimum resolution spot size for recording the toner image.

2. The image forming apparatus as claimed in claim 1, wherein the heating unit is configured to separately heat plural heating parts of the transfer member in an axial direction in a range of 600/72 or more with respect to the minimum resolution spot size for recording the toner image.

3. The image forming apparatus as claimed in claim 1, wherein the heating unit is configured to heat the transfer member in synchronization with the conveyance of the toner image.

4. The image forming apparatus as claimed in claim 1, wherein the heating unit is configured to heat the transfer member by irradiating a laser beam thereto.

5. The image forming apparatus as claimed in claim 4, wherein the transfer member has a light energy absorbing property.

6. The image forming apparatus as claimed in claim 4, wherein the transfer member has a light transmittable property.

7. The image forming apparatus as claimed in claim 4, wherein the laser beam is transmitted from a side of the transfer member that is opposite to the side on which the toner image is situated.

8. The image forming apparatus as claimed in claim 4, further comprising:

a protective member disposed at a prescribed position for receiving the laser beam via the transfer member.

9. The image forming apparatus as claimed in claim 8, wherein the protective member is a member configured to reflect light.

10. The image forming apparatus as claimed in claim 8, wherein the protective member is a member configured to diffuse light.

11. The image forming apparatus as claimed in claim 1, wherein the heating unit includes a thermal head.

12. The image forming apparatus as claimed in claim 1, wherein the toner image is formed by using a toner containing crystalline polyester.

13. The image forming apparatus as claimed in claim 1, wherein the toner image is formed by using a toner containing an infrared absorbing agent.

14. An image forming apparatus, comprising:

a transfer member for carrying a toner image on a surface thereof and transferring the toner image to a recording medium; and a heating unit for selectively heating a part of the surface of a recording medium corresponding to the toner image in a width direction of the transfer member, the width direction of the transfer member perpendicularly intersecting the direction in which the recording medium is conveyed;

wherein the heating unit is configured to separately heat plural heating parts of the recording medium in an axial direction in a range larger than a minimum resolution spot size for recording the toner image.

15. The image forming apparatus as claimed in claim 14, wherein the heating unit is configured to separately heat plural heating parts of the recording medium in an axial direction in a range of 600/72 or more with respect to the minimum resolution spot size for recording the toner image.

16. The image forming apparatus as claimed in claim 14, wherein the heating unit is configured to heat the recording medium in synchronization with the conveyance of the toner image.

17. The image forming apparatus as claimed in claim 14, wherein the heating unit is configured to heat the recording medium by irradiating a laser beam thereto.

18. The image forming apparatus as claimed in claim 14, wherein the heating unit includes a thermal head.

19. The image forming apparatus as claimed in claim 14, wherein the toner image is formed by using a toner containing crystalline polyester.

20. The image forming apparatus as claimed in claim 14, wherein the toner image is formed by using a toner containing an infrared absorbing agent.

21. An image forming apparatus, comprising:

a heating unit for selectively heating a toner image in a width direction of a transfer member, the width direction of the transfer member perpendicularly intersecting the direction in which the toner image is conveyed;

wherein a tracking pattern is formed in an area encompassing the toner image.

* * * * *